US012331502B2

(12) United States Patent
Brenner et al.

(10) Patent No.: US 12,331,502 B2
(45) Date of Patent: Jun. 17, 2025

(54) SYSTEMS AND METHODS FOR RETAINING COMPONENTS WITHIN A SINK

(71) Applicant: iSee Store Innovations, L.L.C., St. Louis, MO (US)

(72) Inventors: Steven Allen Brenner, St. Louis, MO (US); Blake Anderson, St. Louis, MO (US); Matt McCoy, St. Louis, MO (US); Vikas Alluri, Maryland Heights, MO (US)

(73) Assignee: ISEE STORE INOVATIONS, LLC, St. Louis, MO (US)

( * ) Notice: Subject to any disclaimer, the term of this patent is extended or adjusted under 35 U.S.C. 154(b) by 278 days.

(21) Appl. No.: 18/300,480

(22) Filed: Apr. 14, 2023

(65) Prior Publication Data

US 2024/0344306 A1 Oct. 17, 2024

(51) Int. Cl.

| | |
|---|---|
| ***E03C 1/186*** | (2019.01) |
| ***B65D 1/22*** | (2006.01) |
| ***B65D 25/04*** | (2006.01) |
| ***B65D 25/22*** | (2006.01) |
| ***B65D 81/26*** | (2006.01) |

(52) U.S. Cl.

CPC ..... *E03C 1/186* (2013.01); *B65D 1/22* (2013.01); *B65D 25/04* (2013.01); *B65D 25/22* (2013.01); *B65D 81/262* (2013.01)

(58) Field of Classification Search

CPC ..... E03C 1/186; B65D 1/22; B65D 25/04; B65D 25/22; B65D 81/262

USPC ..... 4/454, 619, 680

See application file for complete search history.

(56) References Cited

U.S. PATENT DOCUMENTS

| | | | | | |
|---|---|---|---|---|---|
| 4,728,158 | A * | 3/1988 | D'Elia | A47B 57/06 | 220/532 |
| D314,256 | S * | 1/1991 | Patera | D32/3 | |
| 5,031,974 | A * | 7/1991 | Feucht | A47B 47/025 | 312/263 |
| 5,865,325 | A * | 2/1999 | Comstock | A47K 10/08 | 248/302 |
| 6,029,886 | A * | 2/2000 | Sheffer | B65D 5/248 | 229/168 |
| 6,930,249 | B2 * | 8/2005 | Chen | G11B 33/128 | 174/64 |
| 7,802,688 | B1 * | 9/2010 | Ruan | A47J 47/16 | 248/37.3 |
| 8,701,898 | B2 * | 4/2014 | Chai | A47L 15/505 | 211/41.6 |
| 9,969,526 | B1 * | 5/2018 | Lowther | B65D 19/0034 | |
| 10,343,702 | B2 * | 7/2019 | Stuart | B62B 3/002 | |
| 10,703,538 | B2 * | 7/2020 | Shamp | B65D 77/0453 | |
| 11,247,812 | B2 * | 2/2022 | McMurphy | B65D 21/0233 | |
| 11,702,246 | B2 * | 7/2023 | Cotton | A47J 47/14 | 206/508 |
| 11,814,213 | B2 * | 11/2023 | Hall | B65D 21/0224 | |
| 12,012,269 | B2 * | 6/2024 | Sperlik | B65D 1/243 | |

(Continued)

*Primary Examiner* — Lori L Baker

(74) *Attorney, Agent, or Firm* — Joseph M. Butscher; The Small Patent Law Group LLC

(57) ABSTRACT

A system and a method are configured to retain one or more components within a sink. The system and the method include a bin configured to retain the one or more components, and a mounting panel configured to removably couple the bin to an interior surface of the sink. The mounting panel includes a coupling pad configured to secure to the interior surface of the sink.

30 Claims, 12 Drawing Sheets

(56) References Cited

U.S. PATENT DOCUMENTS

| | | | | |
|---|---|---|---|---|
| 2003/0205259 | A1* | 11/2003 | McConnell | A47L 15/505 211/41.9 |
| 2009/0050585 | A1* | 2/2009 | Lindgren | A47L 15/502 248/37.3 |
| 2012/0025555 | A1* | 2/2012 | Rasmussen | B60P 1/02 248/295.11 |
| 2017/0029169 | A1* | 2/2017 | Shamp | B65D 21/0233 |
| 2017/0203877 | A9* | 7/2017 | Shamp | B65D 1/22 |
| 2018/0251263 | A1* | 9/2018 | Shamp | B65D 21/0233 |
| 2023/0027563 | A1* | 1/2023 | Fadal | A45F 3/02 |
| 2023/0241760 | A1* | 8/2023 | Nair | B25H 3/06 248/220.1 |
| 2024/0009829 | A1* | 1/2024 | Schwei | A47B 47/0091 |
| 2024/0326886 | A1* | 10/2024 | Stuart | B62B 3/04 |

* cited by examiner

SYSTEMS AND METHODS FOR RETAINING COMPONENTS WITHIN A SINK

FIELD OF THE DISCLOSURE

Examples of the present disclosure generally relate to systems and methods for retaining components within a sink.

BACKGROUND OF THE DISCLOSURE

Kitchens, galleys, bathrooms, and the like typically include one or more sinks, which are configured to receive fluids, such as water, and retain dishware, cups, and the like therein. Various components can be used in relation to a sink for a variety of reasons. For example, brushes, dish wands, bottles of cleaning detergents, sponges, and the like can be used to clean glassware, cups, dishes, and other such items within the sink. Typically, when not in use, the components are placed on a countertop surrounding or otherwise by the sink, and/or within a cabinet or drawer. However, storing a component on a countertop or within a cabinet or drawer takes up space that can otherwise be used to store other items. Further, when such items are within a cabinet or drawer, they may not be readily apparent and available to an individual.

SUMMARY OF THE DISCLOSURE

A need exists for a system and a method for retaining components in relation to a sink. Further, a need exists for a system and a method for effectively and efficiently storing components used in relation to a sink that allow counter tops, cabinets, drawers, and the like to be used for storage of other items.

With those needs in mind, certain examples of the present disclosure provide a system configured to retain one or more components within a sink. The system includes a bin configured to retain the one or more components, and a mounting panel configured to removably couple the bin to an interior surface of the sink. The bin defines a retaining chamber.

In at least example, the bin includes a dividing wall that divides the retaining chamber into a first compartment and a second compartment. The dividing wall can include a tab extending from a surface.

In at least one example, the bin includes a base, a front wall upwardly extending from the base, lateral walls upwardly extending from the base and connected to the front wall, and a rear wall upwardly extending from the base and connected to the lateral walls. In at least one example, the retaining chamber is defined between the base, the front wall, the lateral walls, and the rear wall.

In at least one example, an upper ledge extends from at least portions of the front wall, the lateral walls, and the rear wall. One or more hooks can outwardly and upwardly extend from the upper ledge. The one or more hooks can include an upturned outer edge. One or more passages can be formed through the one or more hooks. One or more protuberances can upwardly extend from the upper ledge.

The base can include one or more passages configured to allow liquid to drain therethrough. The base can include an opening extending between one or more of the lateral walls, the front wall, and the rear wall.

In at least one example, a converter flap is within the retaining chamber. The converter flap is configured to be moved between an upright position, at which the opening is exposed, and a covering position, at which the opening is covered.

The mounting panel can be removably secured to the bin.

In at least one example, the mounting panel includes a coupling pad configured to secure to the interior surface of the sink. In at least one example, the mounting panel can also include a support plate, such that the coupling pad extends from the support plate. The support plate can include one or more tabs configured to be removably retained by one or more portions of the bin. The support plate can also include a deflectable engagement handle extending from the one or more tabs. The support plate can also include a sign protuberance. As an example, the sign protuberance extends upwardly through a gap formed in an upper ledge of the bin.

In at least one example, the coupling pad is formed of a nanotechnology polyurethane gel that is configured to adhere to the interior surface of the sink.

The system can also include a front cover removably secured to the bin.

Certain examples of the present disclosure provide a method of retaining one or more components within a sink. The method includes retaining one or more components on or within a bin; and removably coupling, by a mounting panel, the bin to an interior surface of the sink.

DETAILED DESCRIPTION OF THE DISCLOSURE

The foregoing summary, as well as the following detailed description of certain examples will be better understood when read in conjunction with the appended drawings. As used herein, an element or step recited in the singular and preceded by the word "a" or "an" should be understood as not necessarily excluding the plural of the elements or steps. Further, references to "one example" are not intended to be interpreted as excluding the existence of additional examples that also incorporate the recited features. Moreover, unless explicitly stated to the contrary, examples "comprising" or "having" an element or a plurality of elements having a particular condition can include additional elements not having that condition.

Figure 1:
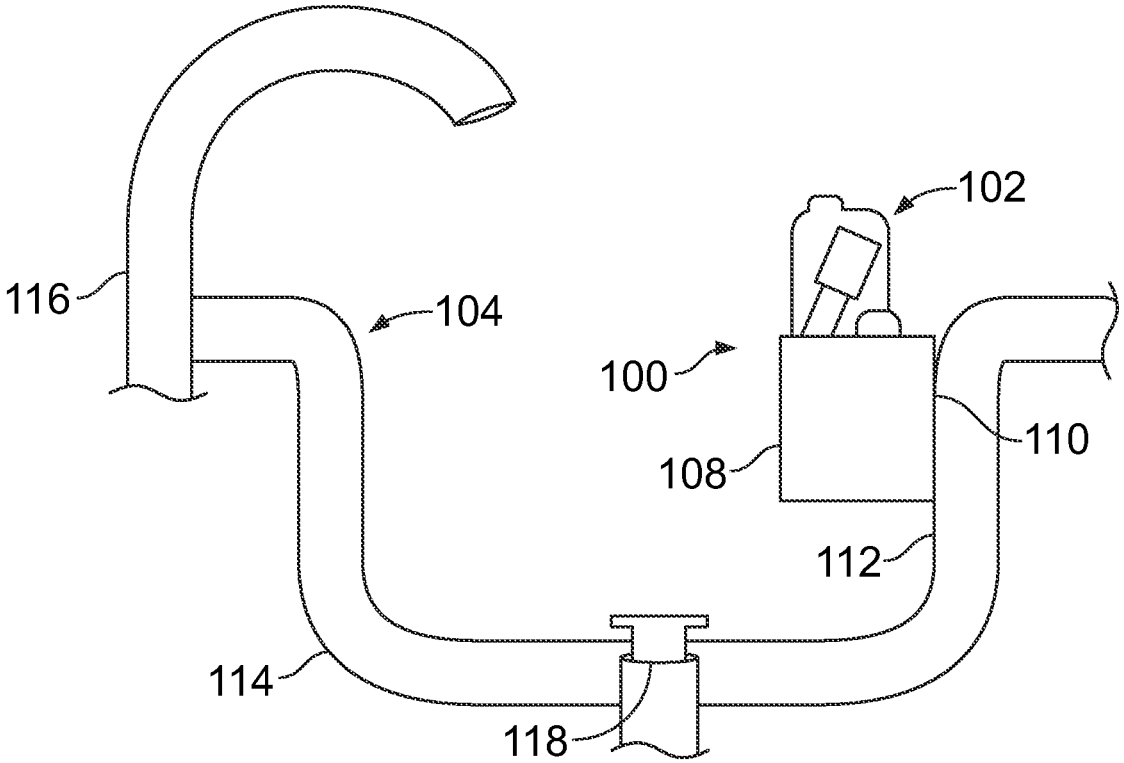
FIG. 1 illustrates a simplified schematic a system for retaining components within a sink, according to an example of the present disclosure.

FIG. 1 illustrates a simplified schematic a system 100 for retaining components 102 within a sink 104, according to an example of the present disclosure. The system 100 includes a bin 108 and a mounting panel 110 that removably secures the retaining bin 108 to an interior surface 112 of the sink 104. The bin 108 is configured to retain one or more components 102. For example, the components 102 can be retained on and/or within the bin 108.

The sink 104 can be within a kitchen, galley, bathroom, or the like. The components 102 can include dish wands, brushes, sponges, rags, bottles of cleaning detergent, and/or the like, such as when the sink 104 is located within a kitchen or galley. As another example, the components 102 can include toothbrushes, tubes of toothpaste, wash cloths, and/or the like when the sink 104 is located within a bathroom.

The sink 104 includes a basin 114 having the interior surface 112. A faucet 116 is configured to dispense water into the basin 114, such that the water can be retained by the interior surface 112. A drain 118 can be disposed within a lower portion of the basin 114. The drain 118 can be opened to allow water retained within the basin 114 to flow out of the basin 114 through the drain 118.

The bin 108 secures to the interior surface 112 within the basin 114 of the sink 104 by the mounting panel 110. The mounting panel 110 secures directly to the interior surface 112. As described herein, the mounting panel 110 secures to the interior surface 112 through a coupling pad, which can be secured to, and removed from (that is, removably secured) the interior surface 112 of the sink 104, as desired. Because the sink 104 is disposed within the sink 104, the components 102 can be retained by the bin 108 therein. As such, counter top space, cabinets, drawers, and the like can be free to store other items, as the components 102 can be retained by the bin 108 within the sink 104.

As described herein, the system 100 is configured to retain the component(s) 102 within the sink 104. The system includes the bin 108 configured to retain the one or more components 102 (such as on and/or within the bin 108). The mounting panel 110 is configured to removably couple the bin 108 to the interior surface 112 of the sink 104.

Figure 2:
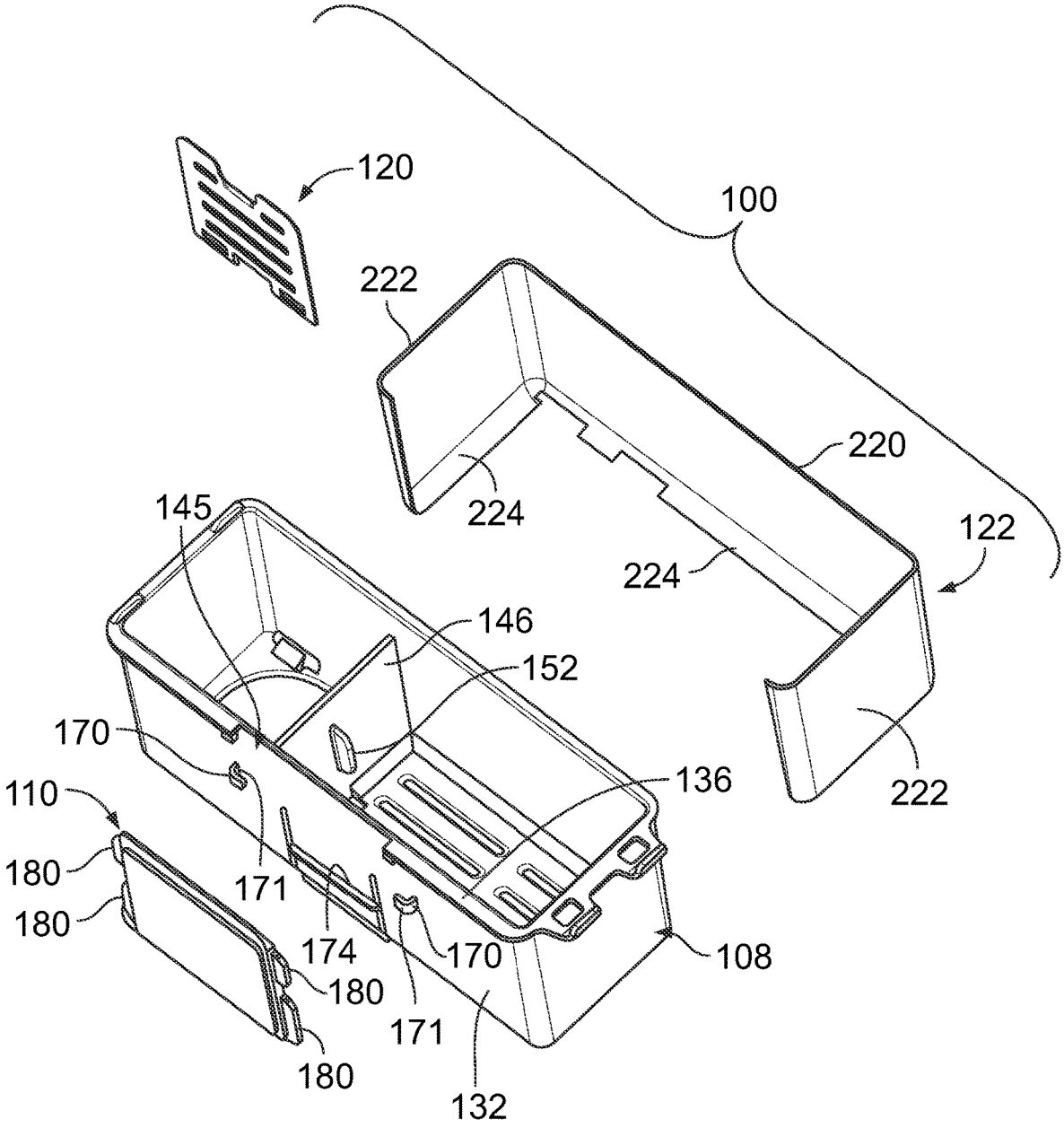
FIG. 2 illustrates an isometric exploded rear view of the system for retaining components within a sink, according to an example of the present disclosure.

FIG. 2 illustrates an isometric exploded rear view of the system 100 for retaining components within a sink, according to an example of the present disclosure. The system 100 includes the bin 108 and the mounting panel 110. In at least one example, the system 100 also includes a converter flap 120 and a front cover 122. Optionally, the system 100 may not include one or both of the converter flap 120 and/or the front cover 122.

Figure 3:
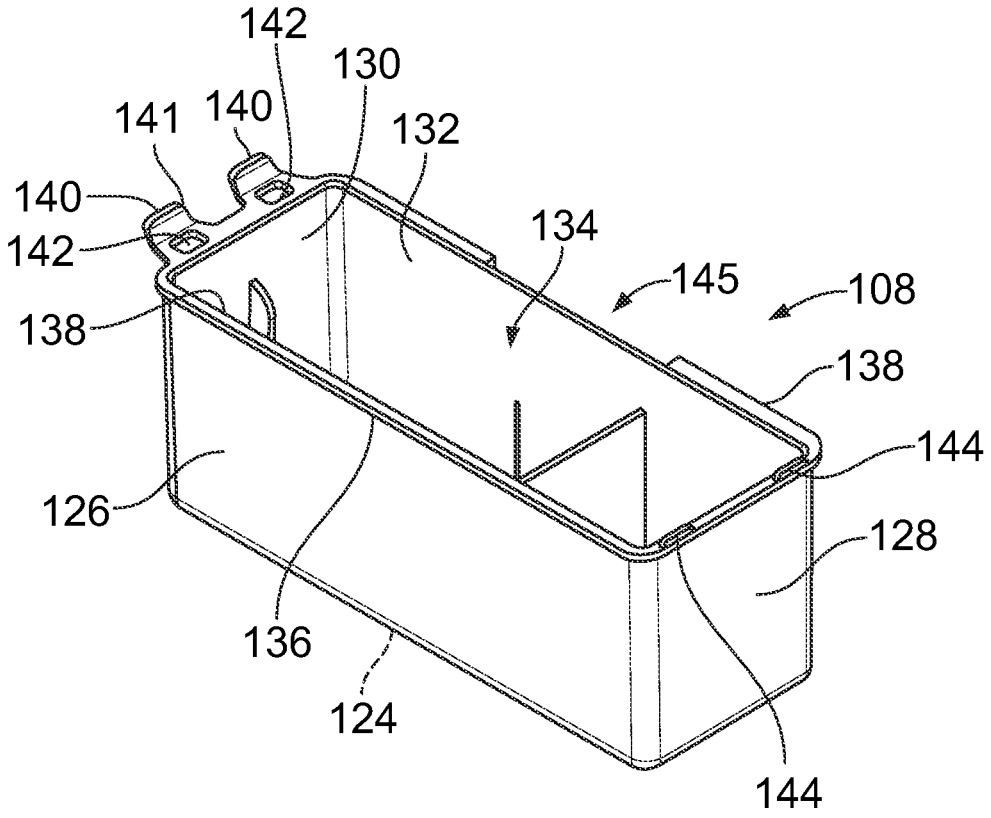
FIG. 3 illustrates an isometric top front view of a bin, according to an example of the present disclosure.

FIG. 3 illustrates an isometric top front view of the bin 108, according to an example of the present disclosure. The bin 108 includes a base 124. A front wall 126 upwardly extends from the base 124. Lateral walls 128 and 130 upwardly extend from the base 124 and connect to the front wall 126. A rear wall 132 that is opposite the front wall 126 also upwardly extends from the base 124 and connects to the lateral walls 128 and 130. A retaining chamber 134 is defined between the base 124, the front wall 126, the lateral walls 128 and 130, and the rear wall 132. Optionally, the bin 108 may be sized and shaped differently, such as having one or more arcuate walls and surfaces, which define the retaining chamber 134. Referring to FIGS. 1-3, one or more components 102 can be retained within the retaining chamber 134.

Figure 4:
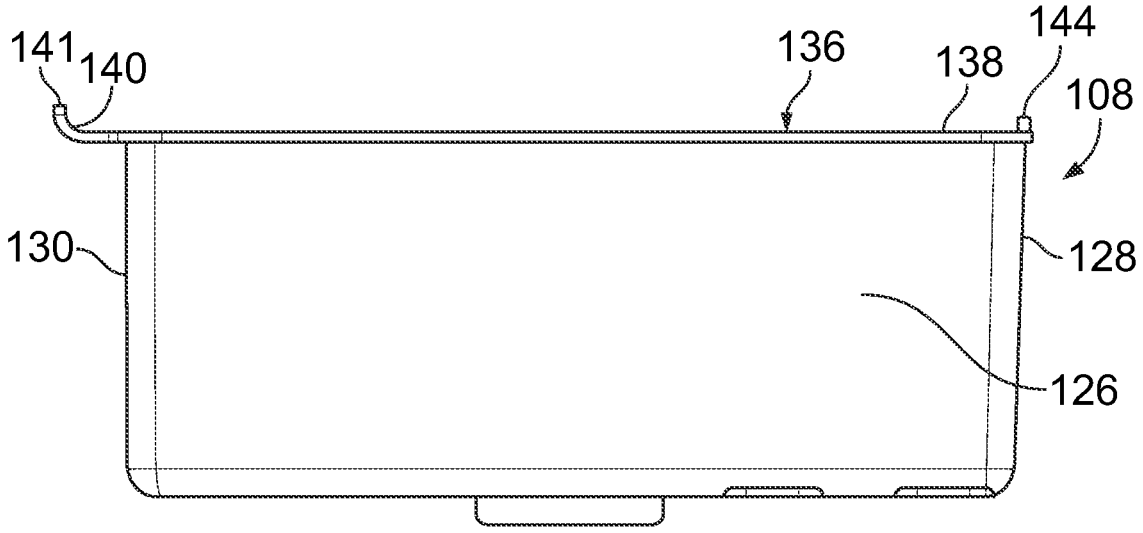
FIG. 4 illustrates a front view of the bin of FIG. 3.

FIG. 4 illustrates a front view of the bin 108 of FIG. 3. Referring to FIGS. 3 and 4, an upper ledge 136 may be outwardly turned from at least portions of the upper edges of the front wall 126, the lateral walls 128, 130, and the rear wall 132. Referring to FIGS. 1-4, one or more components 102 can rest on upper surfaces 138 of the upper ledge 136. For example, a handle of a dish wand can rest on the upper surfaces 138 of the upper ledge 136 spanning over the front wall 126 and the rear wall 132 (or spanning over the lateral walls 128 and 130).

One or more hooks 140 may outwardly and upwardly extend from the upper ledge 136. The hooks 140 include upturned outer edges 141. As shown, two spaced apart hooks 140 can outwardly and upwardly extend from the upper ledge 136 over the lateral wall 130. The hooks 140 can include passages 142 formed through the hooks 140. Components can be secured on the hooks 140. For example, a dish rag can hang from a hook 140. As another example, the spaced-apart hooks 140 can cooperate to retain a brush that rests across the hooks 140. As another example, a handle of a brush can extend through a passage, and the head of the brush can be supported on top of the hook 140.

The bin 108 can include more or less hooks 140 than shown. Further, the hooks 140 can be disposed at various other locations, such as over the front wall 126, the lateral wall 128, and/or the rear wall 132. In at least one other example, the hooks 140 may not include the passages 142. In at least one other example, the bin 108 does not include any hooks.

One or more protuberances 144 (such as bumps, nubs, ridges, or the like) may upwardly extend from the upper ledge 136. As shown, two spaced apart protuberances 144 can upwardly extend from the upper ledge 136 over the lateral wall 128. Components can be secured on and/or between the protuberances 144. For example, a portion of a dish wand can be constrained between two protuberances 144.

The bin 108 can include more or less protuberances 144 than shown. Further, the protuberances 144 can be disposed at various other locations, such as over the front wall 126, the lateral wall 130, and/or the rear wall 132. In at least one other example, the bin 108 does not include any protuberances 144.

In at least one example, a gap 145 forms a space in the upper ledge 136. The gap 145 is formed over the rear wall 132. The gap 145 can be centered in relation to the rear wall 132. The gap 145 allows passage of at least a portion of the mounting panel 110 (shown in FIG. 1). Alternatively, there may not be a gap within the upper ledge 136. Instead, the upper ledge 136 may contiguously extend around an entire upper perimeter of the bin 108.

Figure 5:
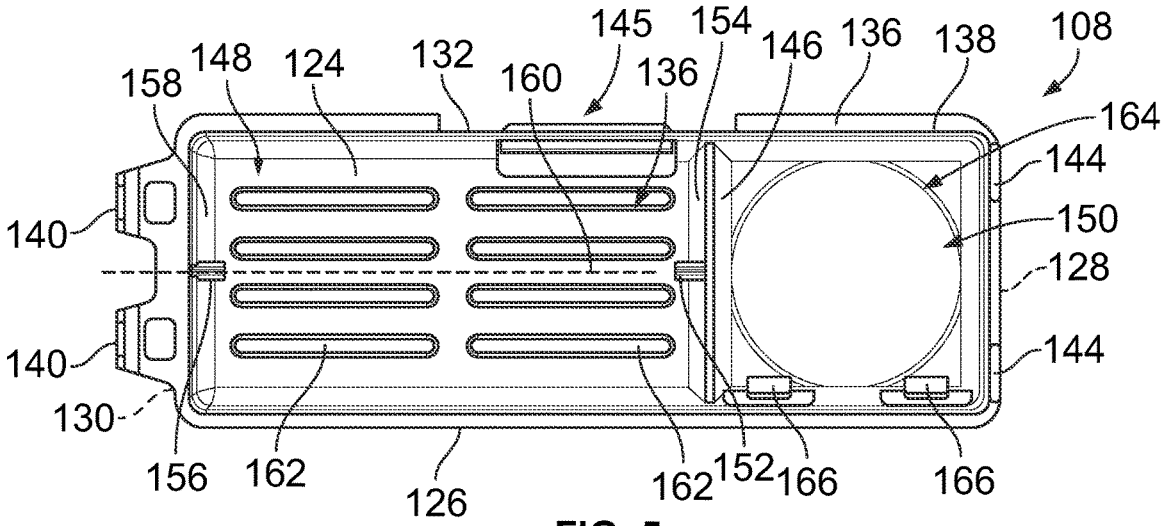
FIG. 5 illustrates a top view of the bin of FIG. 3.

FIG. 5 illustrates a top view of the bin 108 of FIG. 3. Referring to FIGS. 1-5, a dividing wall 146 can upwardly extend from the base 124 between front wall 126 and the rear wall 132. The dividing wall 146 divides the retaining chamber 134 into a first compartment 148 and a second compartment 150. Different components can be secured within each of the first compartment 148 and the second compartment 150.

The dividing wall 146 can include a tab 152 extending from a surface 154 toward the lateral wall 130. Similarly, the lateral wall 130 can also include a tab 156 extending from an interior surface 158 toward the dividing wall 146. The tabs 156 can be linearly aligned along a vertical plane 160, The tabs 156 can be used to securely retain portions of components, separate the first compartment 148 into sub-areas for retaining components, and/or the like. The dividing wall 146 and other portions of the bin 108 can include additional tabs. Optionally, the tabs 156 can be disposed at other areas of the bin 108. As another example, the dividing wall 146 and/or the lateral wall 130 may not include a tab. The bin 108 may optionally include additional dividing walls to further sub-divide the retaining chamber 134 into additional compartments. In at least one other example, the bin 108 may not include a dividing wall, such that the retaining chamber 134 provides a single compartment for retaining components.

One or more passages 162 can be formed through the base 124 within the first compartment 148. The passages 162 allow liquid to drain out of the first compartment 148. The passages 162 can also be used to allow portions of components, such as handles, to pass therethrough, so that the components can hang on the base 124. Passages can also be formed in the base 124 within the second compartment 148. Alternatively, the base 124 may not include passages.

An opening 164 can be formed through the base 124 within the second compartment 150. The opening 164 can extend between the dividing wall 146, the lateral wall 130, the front wall 126, and the rear wall 132, thereby providing a large passage through which larger portions of components, such as large handles, can pass. The opening 164 can optionally be formed in the first compartment 148. The opening 164 can be sized and shaped differently than shown. Optionally, the bin 108 may not include the opening 164.

As shown, one or more hooks 166 extend from interior surfaces of the front wall 126 and/or the base 124. The hooks 166 are disposed at a lower portion of the second compartment 150, such as proximate to the base 124. The hooks 166 are configured to cooperate with portions of the converter flap 120, as described herein, to allow the converter flap 120 to move between an upright position, at which the opening 164 is exposed, and a covering position, at which the opening 164 is covered by the converter flap 120.

Figure 6:
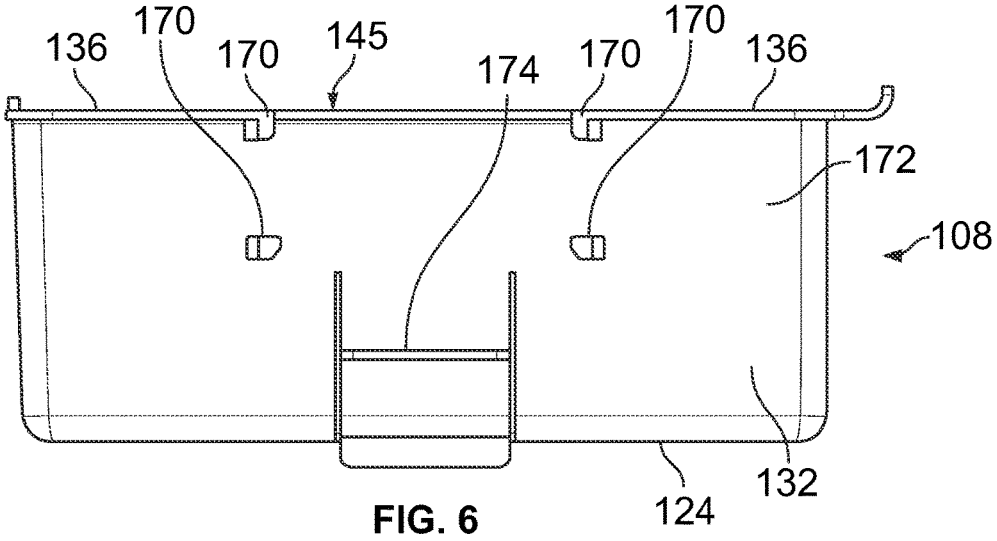
FIG. 6 illustrates a rear view of the bin of FIG. 3.
Figure 7:
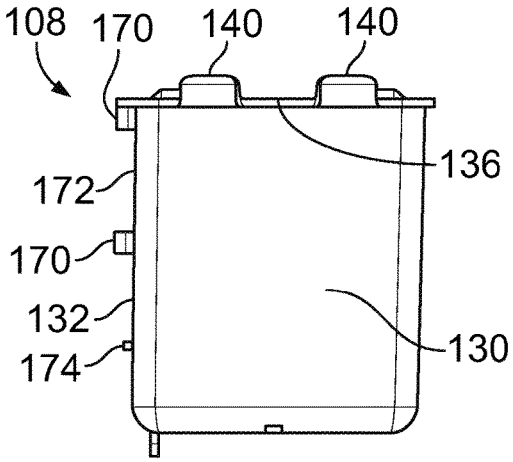
FIG. 7 illustrates a first side view of the bin of FIG. 3.
Figure 8:
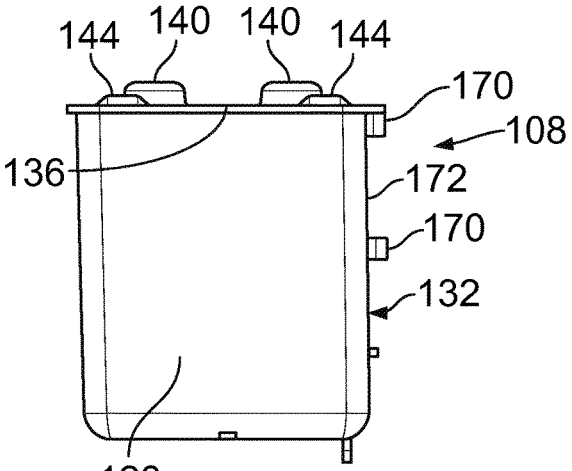
FIG. 8 illustrates a second side view (opposite from the first side view) of the bin of FIG. 3.

FIG. 6 illustrates a rear view of the bin 108 of FIG. 3. FIG. 7 illustrates a first side view of the bin 108 of FIG. 3. FIG. 8 illustrates a second side view (opposite from the first side view) of the bin 108 of FIG. 3. Referring to FIGS. 6-8. Referring to FIGS. 6-8, a plurality of retaining collars 170 outwardly extend from an outer surface 172 of the rear wall 132. For example, a first pair of retaining collars 170 is disposed proximate to the upper ledge 136 about the gap 145, and a second pair of retaining collars 170 is spaced apart and disposed below the first pair of retaining collars 170. The retaining collars 170 include slots that are configured to retain tabs of the mounting panel 110 (shown in FIG. 1). Additionally, a lower ledge 174 outwardly extends from the rear wall 132 above the plane of the base 124 and below the levels of the retaining collars 170.

Figure 9:
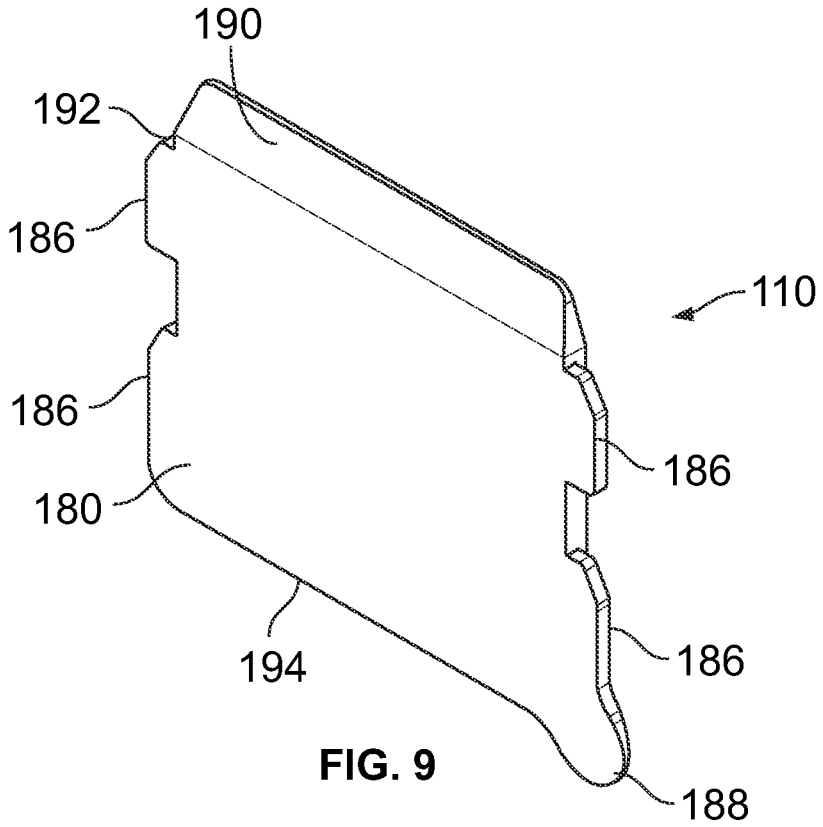
FIG. 9 illustrates an isometric front view of the mounting panel, according to an example of the present disclosure.
Figure 10:
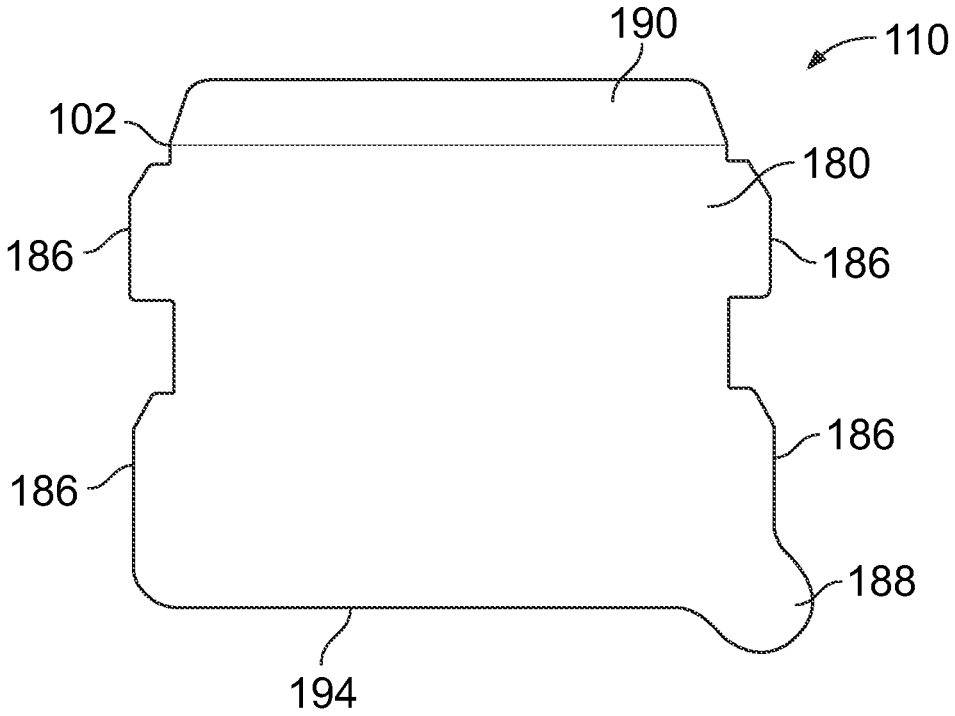
FIG. 10 illustrates a front view of the mounting panel of FIG. 9.
Figure 11:
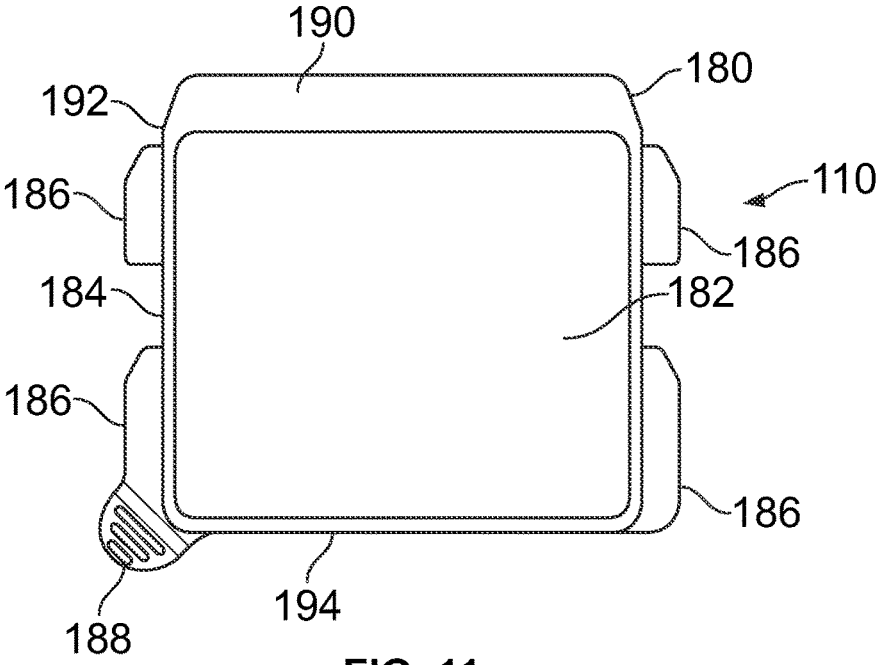
FIG. 11 illustrates a rear view of the mounting panel of FIG. 9.
Figure 12:
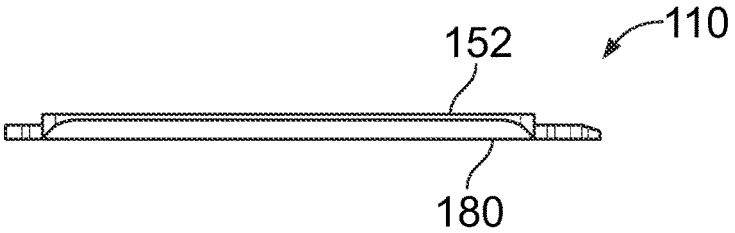
FIG. 12 illustrates a top view of the mounting panel of FIG. 9.
Figure 13:
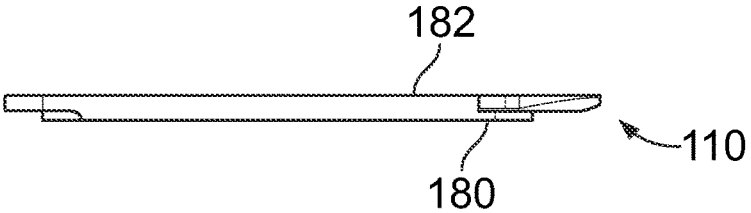
FIG. 13 illustrates a bottom view of the mounting panel of FIG. 9.
Figure 14:
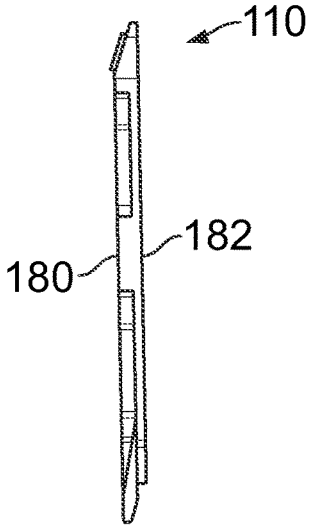
FIG. 14 illustrates a side view of the mounting panel of FIG. 9.

FIG. 9 illustrates an isometric front view of the mounting panel 110, according to an example of the present disclosure. FIG. 10 illustrates a front view of the mounting panel 110 of FIG. 9. FIG. 11 illustrates a rear view of the mounting panel 110 of FIG. 9. FIG. 12 illustrates a top view of the mounting panel 110 of FIG. 9. FIG. 13 illustrates a bottom view of the mounting panel 110 of FIG. 9. FIG. 14 illustrates a side view of the mounting panel 110 of FIG. 9.

Referring to FIGS. 9-14, the mounting panel 110 includes a support plate 180, and a coupling pad 182 secured to and rearwardly extending from a rear surface 184 of the support plate 180. The support plate 180 includes laterally extending tabs 186. A deflectable engagement handle 188 can extend downwardly and outwardly from a lower tab 186.

The coupling pad 182 can extend over substantially all over the rear surface 184 of the support plate 180. For example, the coupling pad 182 extends over a majority of the rear surface 184. The coupling pad 182 does not extend over the tabs 186. The coupling pad 182 is formed of a nanotechnology gel, which is similar to an adhesive, and allows the coupling pad 182 to adhere to the interior surface 112 of the sink 104 (shown in FIG. 1), thereby securing the bin 108 (shown in FIGS. 1-9) to the interior surface 112 of the sink 104. The nanotechnology gel of the coupling pad 182 allows the system 100 to secure to the interior surface 112 of the sink 104 without the use of separate fasteners, adhesives such as glue, or the like. In at least one example, the nanotechnology gel is or otherwise includes a polyurethane gel.

In at least one example, the coupling pad 182 can be removable from the support plate 180. Optionally, the coupling pad 182 can be permanently secured to the support plate 180. The coupling pad 182 is configured to adhere to a surface, such as the interior surface 112 of the sink 104, which can be formed of ceramic, stainless steel, or the like. In at least one example, the coupling pad 182 is formulated to adhere to the interior surface 112 of the sink 104.

As shown, the support plate 180 can also include sign protuberance 190 upwardly extending from an upper edge 192. The sign protuberance 190 provides a planar sheet, beam, wall, or the like that is configured to upwardly extend through the gap 145 when the support plate 180 is secured to the bin 108. The sign protuberance 190 can include text, graphics, or the like, such as a brand name, for example. Optionally, the support plate 180 may not include a sign protuberance.

Referring to FIGS. 1-14, in order to secure the support plate 180 to the rear wall 132 of the bin, the support plate 180 is positioned on the rear wall 132 such that each tab 186 is slid into a slot 171 of a respective collar 170. A lower edge 194 of the support plate 180 rests on the lower ledge 174. In this manner, the support plate 180 is secured to the bin 108, with the sign protuberance 190 extending upwardly through the gap 145.

In order to remove the support plate 180, the engagement handle 188 may be grasped, and deflected rearwardly, thereby causing the lower edge 194 to disengage from the lower ledge 174. The support plate 180 may then be pulled downwardly or upwardly so that the tabs 186 slide out of the slots 171 of the collars 170.

As described, the mounting panel 110 is configured to removably secure to the bin 108, such as via the tabs 186 being retained within the slots 171 of the collars 170 when the lower edge 194 is supported on the lower ledge 174. The upper tabs 186 may extend laterally past the gap 145 and abut into lower surfaces of the upper ledge 136, thereby securely restraining the support plate 180 on the rear wall 132 of the bin 108. Optionally, the mounting panel 110 can be removably secured to the bin 108 through various other structures, such as deflectable clips, fasteners, or the like. In at least one other example, the mounting panel 110 can be permanently secured to the bin 108. For example, the support plate 180 can be integrally formed and molded with the rear wall 132 of the bin 108. As another example, the coupling pad 182 can be directly coupled to the rear wall 132 without a support plate.

Figure 15:
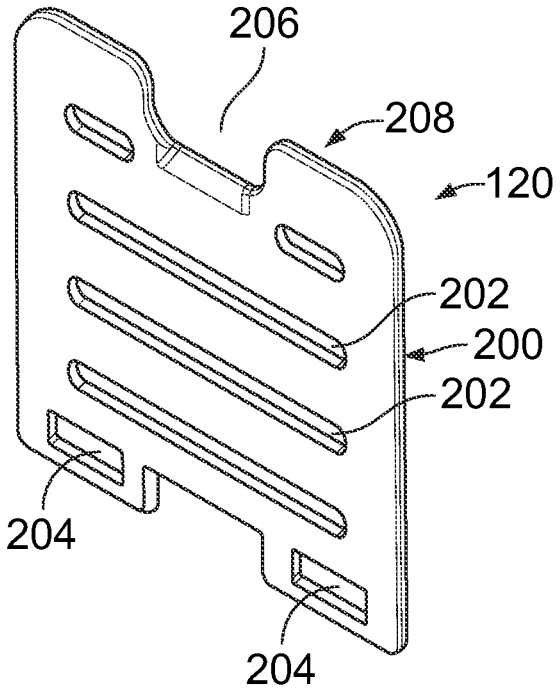
FIG. 15 illustrates an isometric front view of a converter flap, according to an example of the present disclosure.
Figure 16:
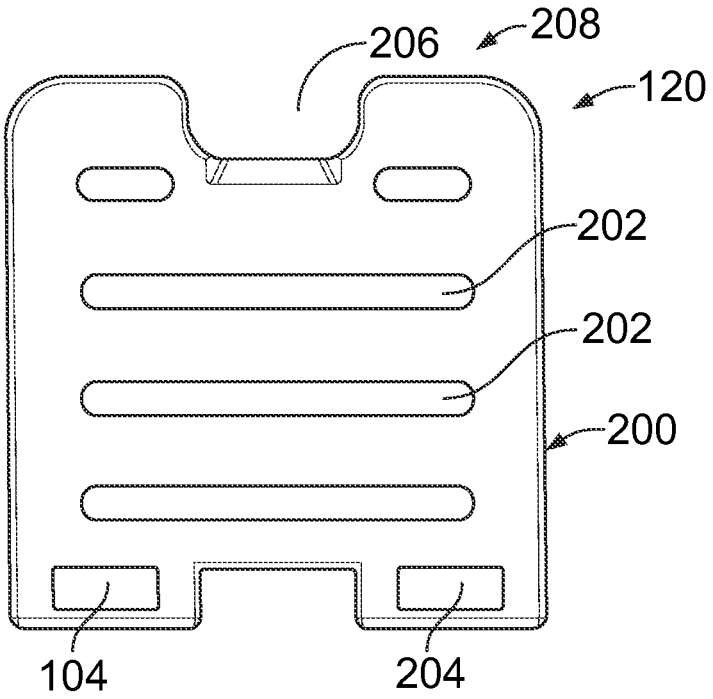
FIG. 16 illustrates a front view of the converter flap of FIG. 15.
Figure 17:
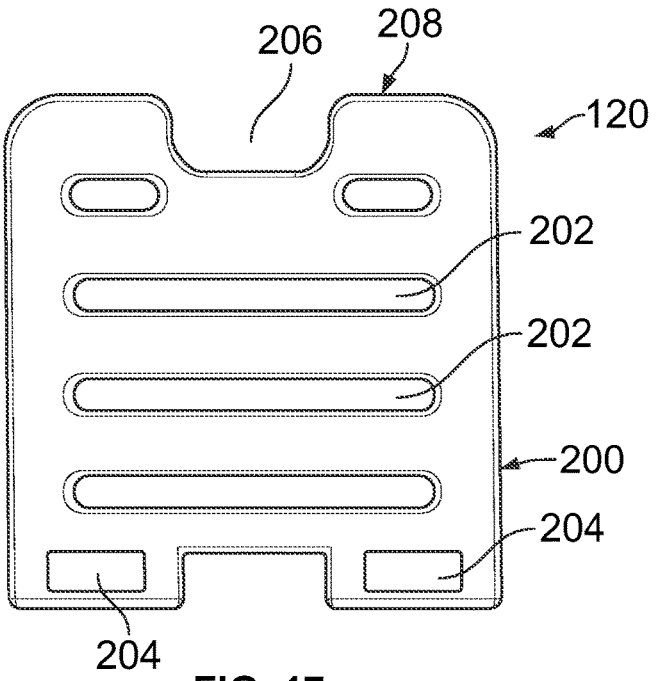
FIG. 17 illustrates a rear view of the converter flap of FIG. 15.
Figure 18:
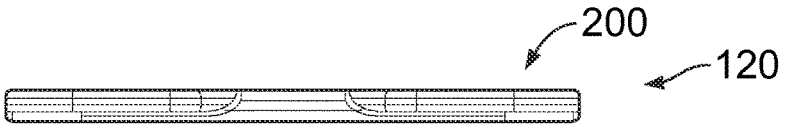
FIG. 18 illustrates a top view of the converter flap of FIG. 15.
Figure 19:
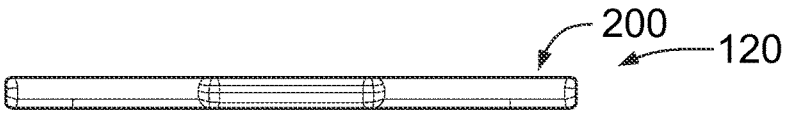
FIG. 19 illustrates a bottom view of the converter flap of FIG. 15.
Figure 20:
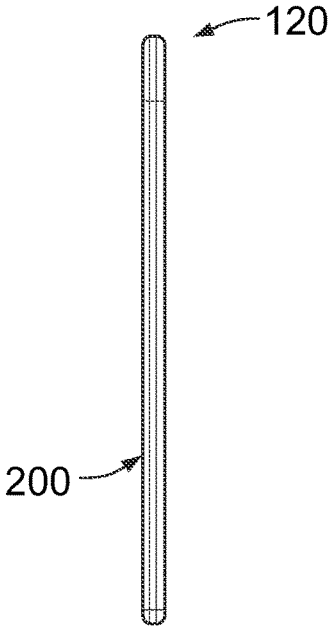
FIG. 20 illustrates a side view of the converter flap of FIG. 15.

FIG. 15 illustrates an isometric front view of the converter flap 120, according to an example of the present disclosure. FIG. 16 illustrates a front view of the converter flap 120 of FIG. 15. FIG. 17 illustrates a rear view of the converter flap 120 of FIG. 15. FIG. 18 illustrates a top view of the converter flap 120 of FIG. 15. FIG. 19 illustrates a bottom view of the converter flap 120 of FIG. 15. FIG. 20 illustrates a side view of the converter flap 120 of FIG. 15.

Referring to FIGS. 15-20, the converter flap 120 includes a flat main body 200. A plurality of passages 202 can be formed through the main body 200. The passages 202 can be configured for drainage, and extension therethrough of portions of a component, as described with respect to the passages 162 shown in FIG. 5, for example. Optionally, the flap 120 may not include the passages 162.

Hook channels 204 are formed through lower portions of the main body 200. A grasp recess 206 can be formed at an upper end 208 of the main body 200.

Referring to FIGS. 2, 5, and 15-20, the hooks 166 extending from interior surfaces of the front wall 126 and/or the base 124 cooperate with the hook channels 204 of the converter flap 120 to allow the converter flap 120 to move between an upright position, at which the opening 164 is exposed, and a covering position, at which the opening 164 is covered by the converter flap 120. For example, the hooks 166 extend through the hook channels 204, thereby allowing the converter flap 120 to be pivoted between the upright position and the covering position. An individual may easily grasp the converter flap 120 by way of the grasp recess 206 to pivot the converter flap 120 between the upright position and the covering position. The converter flap 120 can be removed from the hooks 166, so that the converter flap 120 can be removed from the bin 108.

Figure 21:
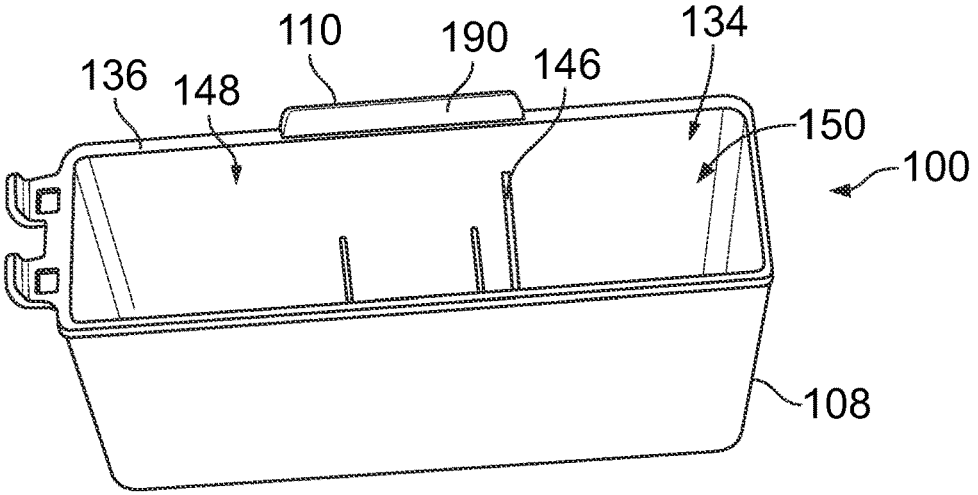
FIG. 21 illustrates an isometric front view of the system of FIG. 2.

FIG. 21 illustrates an isometric front view of the system 100 of FIG. 2. As shown, the sign protuberance 190 of the mounting panel 110 extends through the gap 145 (shown in FIGS. 2, 3, 5, and 6, for example) above the upper ledge 136.

Figure 22:
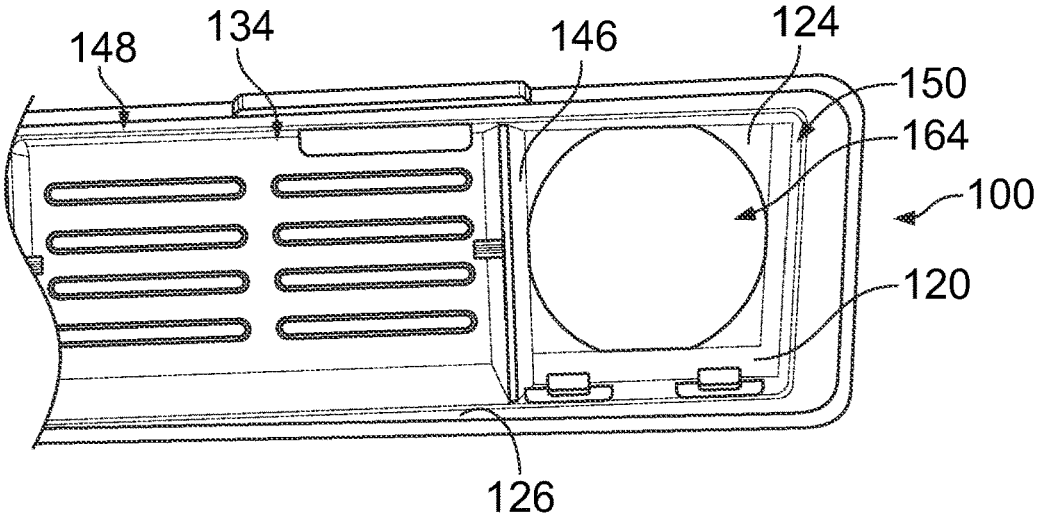
FIG. 22 illustrates a top view of the system having the converter flap in an upright position.

FIG. 22 illustrates a top view of the system 100 having the converter flap 120 in an upright position. In the upright position, the converter flap 120 is vertically oriented and may be flat against an interior surface of the bin 108, such as an interior surface of a portion of the front wall 126. When the converter flap 120 is in the upright position, the opening 164 formed through the base 124 is exposed.

Figure 23:
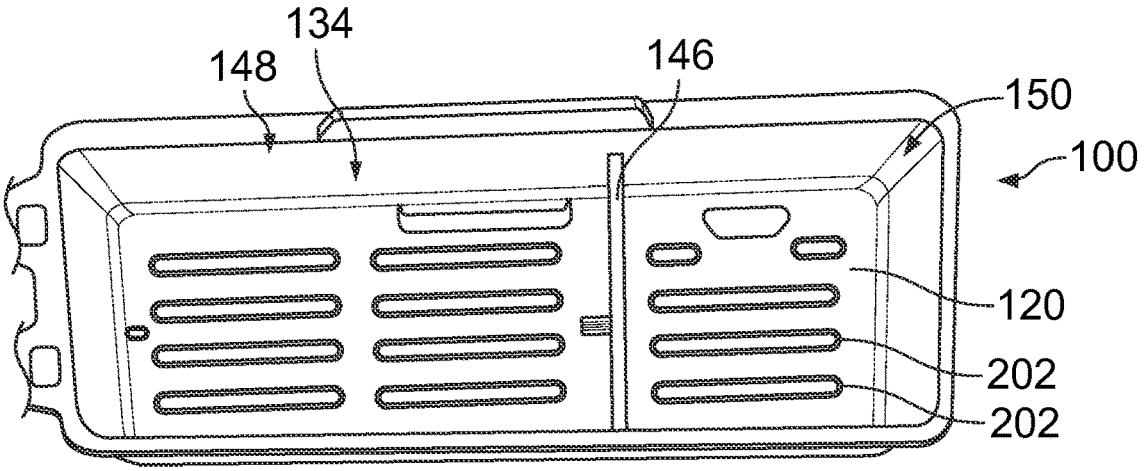
FIG. 23 illustrates a top view of the system having the converter flap in a covering position.

FIG. 23 illustrates a top view of the system 100 having the converter flap 120 in a covering position. In the covering position, the converter flap 120 lays flat over the portion of the base 124 surrounding the opening 164 (shown in FIG. 22). The base 124 may include recessed portions that allow the converter flap 120 to be coplanar with the portion of the base 124 within the first compartment 148, for example. When the converter flap 120 is in the covering position, the opening 164 formed through the base 124 is covered. The passages 202 allow liquid to drain therethrough and into and through the opening 164.

Referring again to FIG. 2, the system 100 can also include the front cover 122. The front cover 122 includes a front face 220 and side panels 222 extending rearwardly from opposite ends of the front face 220. A lower ledge 224 can also extend from bottom edges of the front face 220 and side panels 222. The front face 220, the side panels 222, and the lower ledge 224 can be deflectable to allow the front cover 122 to snap over portions of the bin 108. For example, referring to FIGS. 2-8, the front face 220 fits over of the front wall 126, and the side panels 222 fit over the lateral walls 128 and 130. The front cover 122 is configured to be removably secured to the bin 108. The front cover 122 can be a decorative cover including text, graphics, and/or the like. As another example, the front cover 122 can provide an aesthetically preferred appearance, such as a stainless steel appearance. Optionally, the system 100 does not include the front cover 122.

Figure 24:
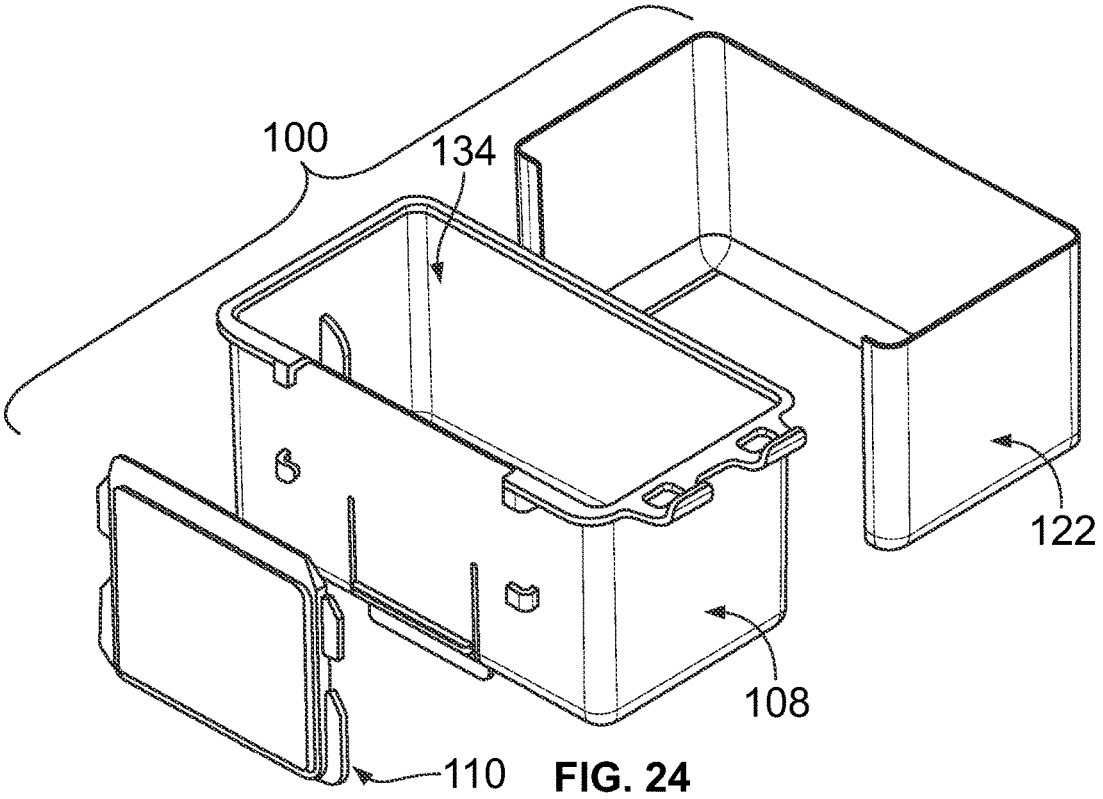
FIG. 24 illustrates an isometric exploded rear view of the system for retaining components within a sink, according to an example of the present disclosure.
Figure 25:
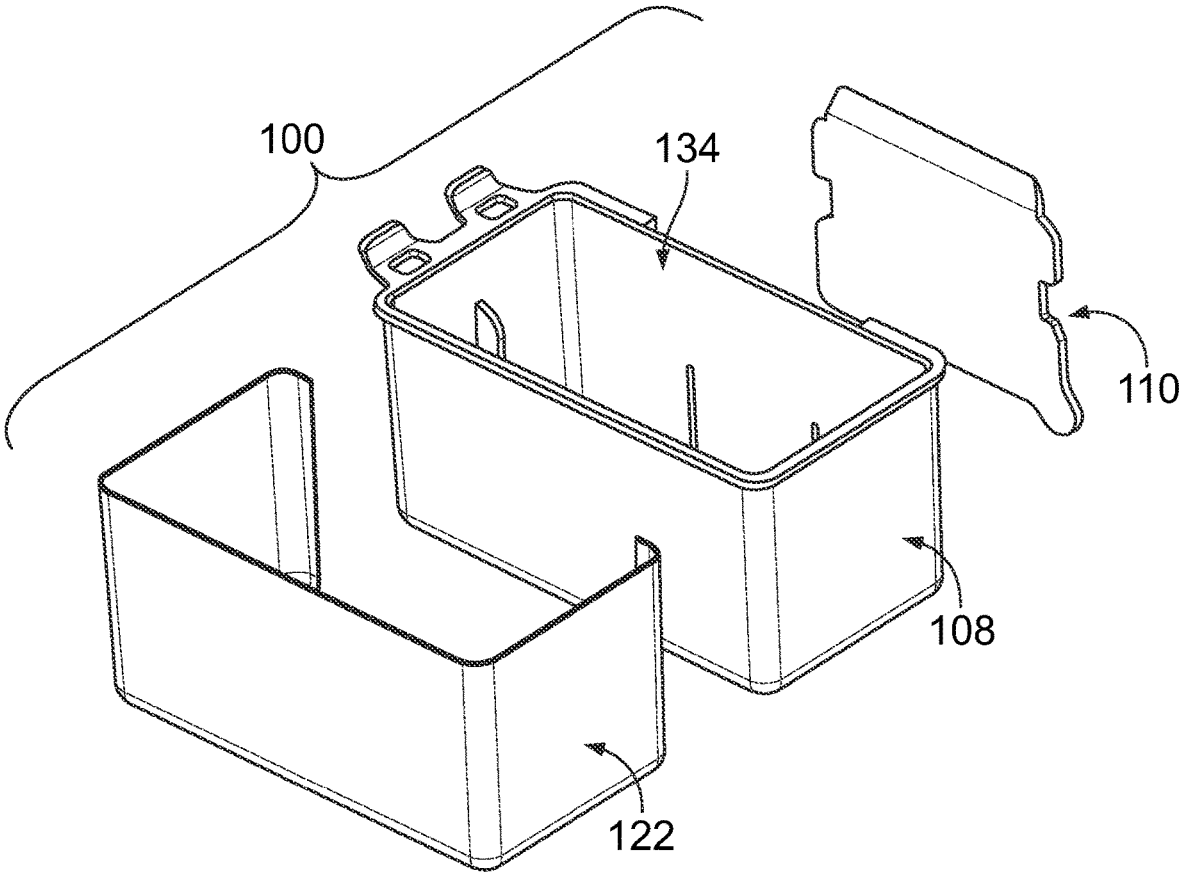
FIG. 25 illustrates an isometric exploded front view of the system of FIG. 24.
Figure 26:
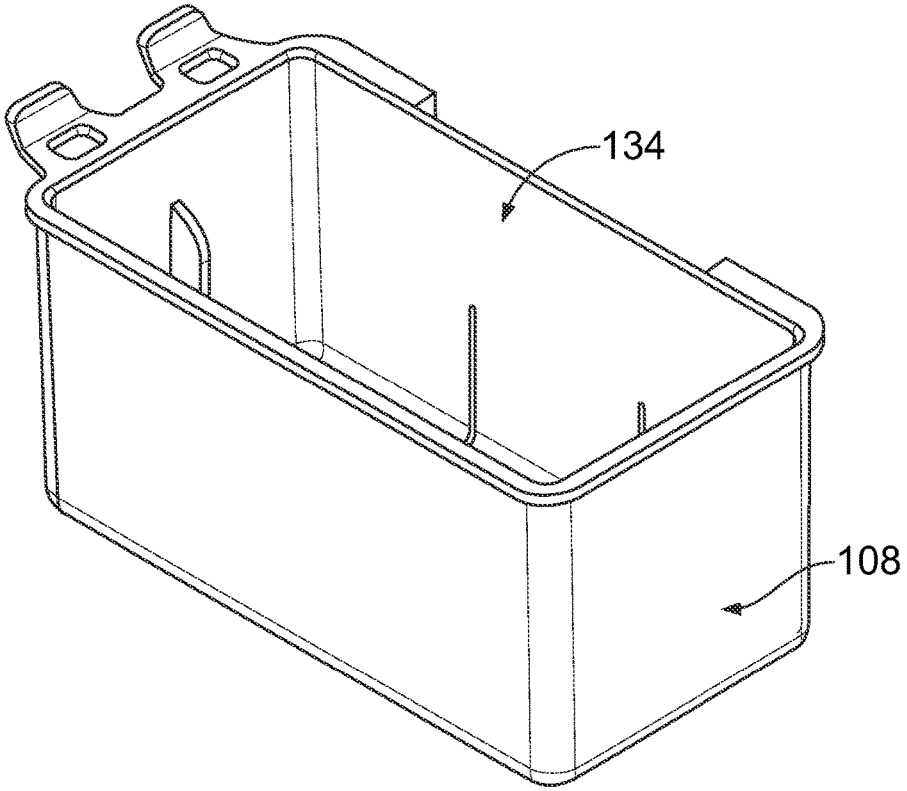
FIG. 26 illustrates an isometric top front view of a bin, according to an example of the present disclosure.
Figure 27:
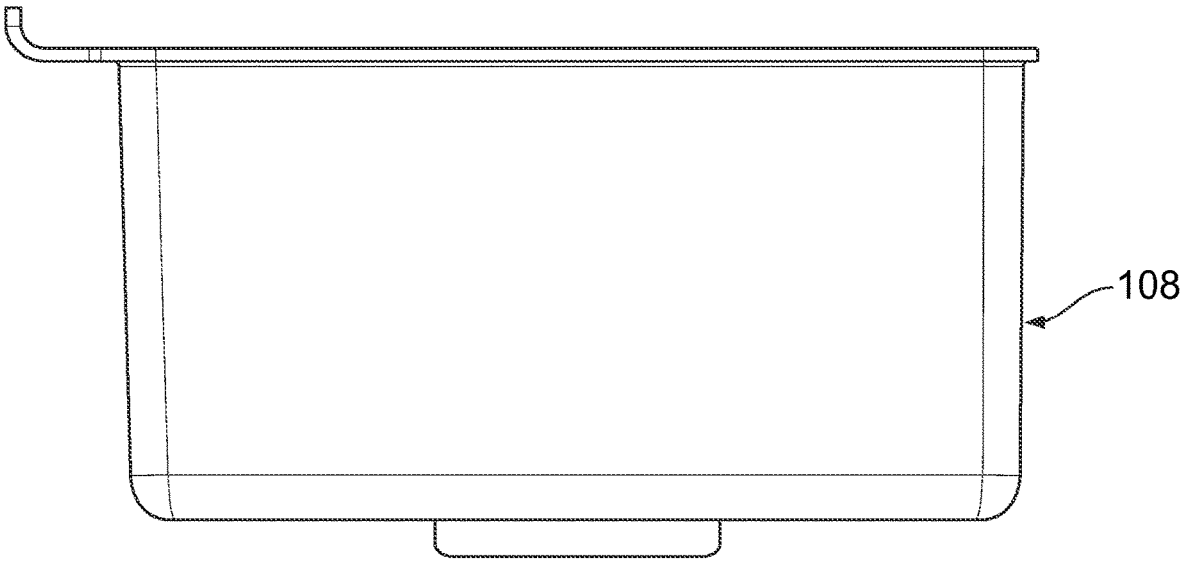
FIG. 27 illustrates a front view of the bin of FIG. 26.
Figure 28:
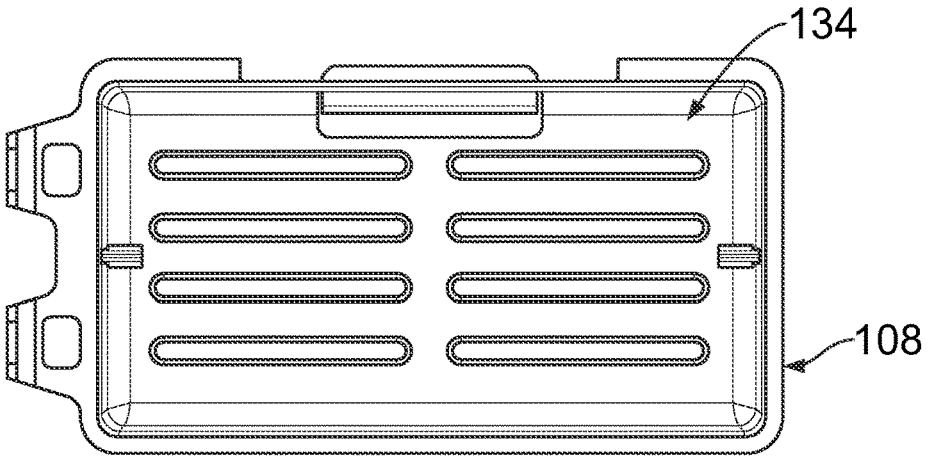
FIG. 28 illustrates a top view of the bin of FIG. 26.
Figure 29:
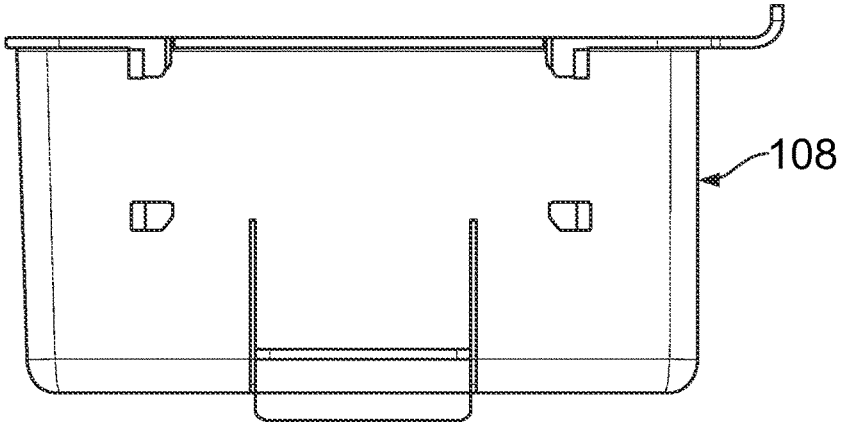
FIG. 29 illustrates a rear view of the bin of FIG. 26.
Figure 30:
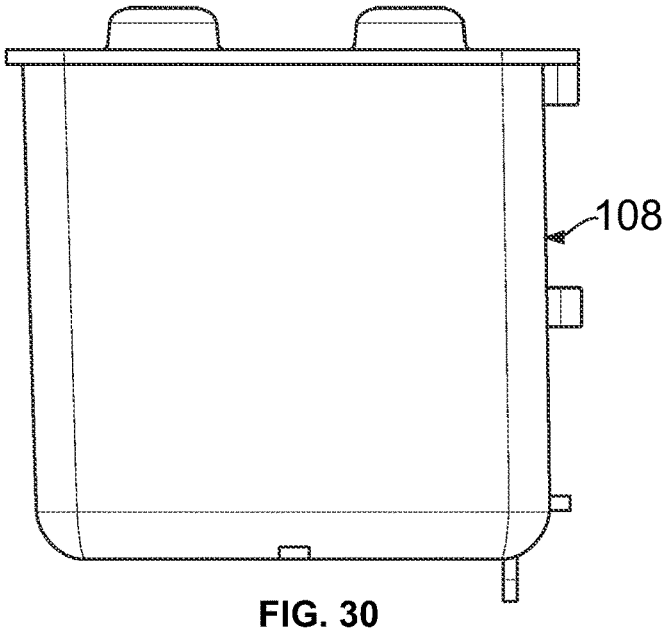
FIG. 30 illustrates a side view of the bin of FIG. 26.

FIG. 24 illustrates an isometric exploded rear view of the system 100 for retaining components within a sink, according to an example of the present disclosure. FIG. 25 illustrates an isometric exploded front view of the system 100 of FIG. 24. FIG. 26 illustrates an isometric top front view of a bin 108, according to an example of the present disclosure. FIG. 27 illustrates a front view of the bin 108 of FIG. 26. FIG. 28 illustrates a top view of the bin 108 of FIG. 26. FIG. 29 illustrates a rear view of the bin 108 of FIG. 26. FIG. 30 illustrates a side view of the bin 108 of FIG. 26.

Referring to FIGS. 24-30, the system 100 is similar to the system 100 shown and described with respect to FIGS. 2-23, except that the bin 108 is sized and shaped differently. For example, the bin 108 may include a retaining chamber 134 without divided compartments. The bin 108 may not include a dividing wall. Further, the system 100 may not include a converter flap.

Further, the disclosure comprises examples according to the following clauses:

Clause 1. A system configured to retain one or more components within a sink, the system comprising:

a bin configured to retain the one or more components; and a mounting panel configured to removably couple the bin to an interior surface of the sink.

Clause 2. The system of Clause 1, wherein the bin defines a retaining chamber.

Clause 3. The system of Clause 2, wherein the bin comprises a dividing wall that divides the retaining chamber into a first compartment and a second compartment.

Clause 4. The system of Clause 3, wherein the dividing wall includes a tab extending from a surface.

Clause 5. The system of any of Clauses 2-4, wherein the bin comprises:

a base;

a front wall upwardly extending from the base;

lateral walls upwardly extending from the base and connected to the front wall; and a rear wall upwardly extending from the base and connected to the lateral walls, wherein the retaining chamber is defined between the base, the front wall, the lateral walls, and the rear wall.

Clause 6. The system of Clause 5, wherein an upper ledge extends from at least portions of the front wall, the lateral walls, and the rear wall.

Clause 7. The system of Clause 6, further comprising one or more hooks outwardly and upwardly extending from the upper ledge.

Clause 8. The system of Clause 7, wherein the one or more hooks comprise an upturned outer edge.

Clause 9. The system of Clauses 7 or 8, wherein one or more passages are formed through the one or more hooks.

Clause 10. The system of Clauses 6-9, further comprising one or more protuberances upwardly extending from the upper ledge.

Clause 11. The system of any of Clauses 5-10, wherein the base comprises one or more passages configured to allow liquid to drain therethrough.

Clause 12. The system of any of Clauses 5-11, wherein the base further comprises an opening extending between one or more of the lateral walls, the front wall, and the rear wall.

Clause 13. The system of Clause 12, further comprising a converter flap within the retaining chamber, wherein the converter flap is configured to be moved between an upright position, at which the opening is exposed, and a covering position, at which the opening is covered.

Clause 14. The system of any of Clauses 1-13, wherein the mounting panel is removably secured to the bin.

Clause 15. The system of any of Clauses 1-14, wherein the mounting panel comprises a coupling pad configured to secure to the interior surface of the sink.

Clause 16. The system of Clause 15, wherein the mounting panel further comprises a support plate, wherein the coupling pad extends from the support plate.

Clause 17. The system of Clause 16, wherein the support plate comprises one or more tabs configured to be removably retained by one or more portions of the bin.

Clause 18. The system of Clause 17, wherein the support plate further comprises a deflectable engagement handle extending from the one or more tabs.

Clause 19. The system of any of Clauses 16-18, wherein the support plate further comprises a sign protuberance.

Clause 20. The system of Clause 19, wherein the sign protuberance extends upwardly through a gap formed in an upper ledge of the bin.

Clause 21. The system of any of Clauses 15-20, wherein the coupling pad is formed of a nanotechnology polyurethane gel that is configured to adhere to the interior surface of the sink.

Clause 22. The system of any of Clauses 1-21, further comprising a front cover removably secured to the bin.

Clause 23. A method of retaining one or more components within a sink, the method comprising:

retaining one or more components on or within a bin; and removably coupling, by a mounting panel, the bin to an interior surface of the sink.

Clause 24. The method of Clause 23, wherein the mounting panel comprises a coupling pad formed of a nanotechnology polyurethane gel, wherein said removably coupling comprises adhering the coupling pad to the interior surface of the sink.

Clause 25. A system configured to retain one or more components within a sink, the system comprising:

a bin configured to retain the one or more components, wherein the bin defines a retaining chamber;

a dividing wall that divides the retaining chamber into a first compartment and a second compartment; and a mounting panel configured to removably couple the bin to an interior surface of the sink, wherein the mounting panel comprises:

coupling pad configured to secure to the interior surface of the sink, wherein the coupling pad is formed of a nanotechnology polyurethane gel that is configured to adhere to the interior surface of the sink; and a support plate, wherein the coupling pad extends from the support plate, wherein the support plate comprises one or more tabs configured to be removably retained by one or more portions of the bin, and a deflectable engagement handle extending from the one or more tabs.

Clause 26. The system of Clause 25, wherein the bin comprises:

a base including one or more passages configured to allow liquid to drain therethrough, and an opening;

a front wall upwardly extending from the base;

lateral walls upwardly extending from the base and connected to the front wall; and a rear wall upwardly extending from the base and connected to the lateral walls, wherein the retaining chamber is defined between the base, the front wall, the lateral walls, and the rear wall, and wherein the opening extends between one or more of the lateral walls, the front wall, and the rear wall.

Clause 27. The system of Clause 26, wherein an upper ledge extends from at least portions of the front wall, the lateral walls, and the rear wall.

Clause 28. The system of Clause 27, further comprising one or more hooks outwardly and upwardly extending from the upper ledge, wherein the one or more hooks comprise an upturned outer edge, and wherein one or more passages are formed through the one or more hooks.

Clause 29. The system of Clause 28, further comprising one or more protuberances upwardly extending from the upper ledge.

Clause 30. The system of Clause 29, further comprising a converter flap within the retaining chamber, wherein the converter flap is configured to be moved between an upright position, at which the opening is exposed, and a covering position, at which the opening is covered.

Clause 31. The system of Clause 30, wherein the support plate further comprises a sign protuberance extending upwardly through a gap formed in the upper ledge.

Clause 32. The system of Clause 31, further comprising a front cover removably secured to the bin.

As described herein, examples of the present disclosure provide systems and methods for retaining components in relation to a sink, particularly within the sink. Further, examples of the present disclosure provide systems and methods for effectively and efficiently storing components used in relation to a sink that allow counter tops, cabinets, drawers, and the like to be used for storage of other items.

While various spatial and directional terms, such as top, bottom, lower, mid, lateral, horizontal, vertical, front and the like can be used to describe examples of the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described examples (and/or aspects thereof) can be used in combination with each other. In addition, many modifications can be made to adapt a particular situation or material to the teachings of the various examples of the disclosure without departing from their scope. While the dimensions and types of materials described herein are intended to define the aspects of the various examples of the disclosure, the examples are by no means limiting and are exemplary examples. Many other examples will be apparent to those of skill in the art upon reviewing the above description. The scope of the various examples of the disclosure should, therefore, be determined with reference to the appended claims, along with the full scope of equivalents to which such claims are entitled. In the appended claims and the detailed description herein, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112 (f), unless and until such claim limitations expressly use the phrase "means for" followed by a statement of function void of further structure.

This written description uses examples to disclose the various examples of the disclosure, including the best mode, and also to enable any person skilled in the art to practice the various examples of the disclosure, including making and using any devices or systems and performing any incorporated methods. The patentable scope of the various examples of the disclosure is defined by the claims, and can include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A system configured to retain one or more components within a sink, the system comprising:

a bin configured to retain the one or more components; and a mounting panel configured to removably couple the bin to an interior surface of the sink, wherein the mounting panel comprises a coupling pad configured to secure to the interior surface of the sink.

2. The system of claim 1, wherein the bin defines a retaining chamber.

3. The system of claim 2, wherein the bin comprises a dividing wall that divides the retaining chamber into a first compartment and a second compartment.

4. The system of claim 3, wherein the dividing wall includes a tab extending from a surface.

5. The system of claim 2, wherein the bin comprises:

a base;

a front wall upwardly extending from the base;

lateral walls upwardly extending from the base and connected to the front wall; and a rear wall upwardly extending from the base and connected to the lateral walls, wherein the retaining chamber is defined between the base, the front wall, the lateral walls, and the rear wall.

6. The system of claim 5, wherein an upper ledge extends from at least portions of the front wall, the lateral walls, and the rear wall.

7. The system of claim 6, further comprising one or more hooks outwardly and upwardly extending from the upper ledge.

8. The system of claim 7, wherein the one or more hooks comprise an upturned outer edge.

9. The system of claim 7, wherein one or more passages are formed through the one or more hooks.

10. The system of claim 6, further comprising one or more protuberances upwardly extending from the upper ledge.

11. The system of claim 5, wherein the base comprises one or more passages configured to allow liquid to drain therethrough.

12. The system of claim 5, wherein the base further comprises an opening extending between one or more of the lateral walls, the front wall, and the rear wall.

13. The system of claim 12, further comprising a converter flap within the retaining chamber, wherein the converter flap is configured to be moved between an upright position, at which the opening is exposed, and a covering position, at which the opening is covered.

14. The system of claim 1, wherein the mounting panel is removably secured to the bin.

15. The system of claim 1, wherein the mounting panel further comprises a support plate, wherein the coupling pad extends from the support plate.

16. The system of claim 15, wherein the support plate comprises one or more tabs configured to be removably retained by one or more portions of the bin.

17. The system of claim 16, wherein the support plate further comprises a deflectable engagement handle extending from the one or more tabs.

18. The system of claim 15, wherein the support plate further comprises a sign protuberance.

19. The system of claim 18, wherein the sign protuberance extends upwardly through a gap formed in an upper ledge of the bin.

20. The system of claim 1, wherein the coupling pad is formed of a nanotechnology polyurethane gel that is configured to adhere to the interior surface of the sink.

21. The system of claim 1, further comprising a front cover removably secured to the bin.

22. A method of retaining one or more components within a sink, the method comprising:

retaining one or more components on or within a bin; and removably coupling, by a mounting panel, the bin to an interior surface of the sink, wherein the mounting panel comprises a coupling pad formed of a nanotechnology polyurethane gel, and wherein said removably coupling comprises adhering the coupling pad to the interior surface of the sink.

23. A system configured to retain one or more components within a sink, the system comprising:

a bin configured to retain the one or more components, wherein the bin defines a retaining chamber;

a dividing wall that divides the retaining chamber into a first compartment and a second compartment; and a mounting panel configured to removably couple the bin to an interior surface of the sink, wherein the mounting panel comprises:

a coupling pad configured to secure to the interior surface of the sink, wherein the coupling pad is formed of a nanotechnology polyurethane gel that is configured to adhere to the interior surface of the sink; and a support plate, wherein the coupling pad extends from the support plate, wherein the support plate comprises one or more tabs configured to be removably retained by one or more portions of the bin, and a deflectable engagement handle extending from the one or more tabs.

24. The system of claim 23, wherein the bin comprises:

a base including one or more passages configured to allow liquid to drain therethrough, and an opening;

a front wall upwardly extending from the base;

lateral walls upwardly extending from the base and connected to the front wall; and a rear wall upwardly extending from the base and connected to the lateral walls, wherein the retaining chamber is defined between the base, the front wall, the lateral walls, and the rear wall, and wherein the opening extends between one or more of the lateral walls, the front wall, and the rear wall.

25. The system of claim 24, wherein an upper ledge extends from at least portions of the front wall, the lateral walls, and the rear wall.

26. The system of claim 25, further comprising one or more hooks outwardly and upwardly extending from the upper ledge, wherein the one or more hooks comprise an upturned outer edge, and wherein one or more passages are formed through the one or more hooks.

27. The system of claim 26, further comprising one or more protuberances upwardly extending from the upper ledge.

28. The system of claim 27, further comprising a converter flap within the retaining chamber, wherein the converter flap is configured to be moved between an upright position, at which the opening is exposed, and a covering position, at which the opening is covered.

29. The system of claim 28, wherein the support plate further comprises a sign protuberance extending upwardly through a gap formed in the upper ledge.

30. The system of claim 29, further comprising a front cover removably secured to the bin.

* * * * *